US008708648B2

(12) United States Patent
Küpper et al.

(10) Patent No.: US 8,708,648 B2
(45) Date of Patent: Apr. 29, 2014

(54) DEVICE FOR A HORIZONTALLY SPLIT TURBOMACHINE HOUSING, GUIDE VANE RING SEGMENT AND GUIDE VANE CARRIER FOR A HORIZONTALLY SPLIT TURBOMACHINE HOUSING

(75) Inventors: Alexander Küpper, Mülheim an der Ruhr (DE); Walter Loch, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 599 days.

(21) Appl. No.: 12/935,995

(22) PCT Filed: Feb. 11, 2009

(86) PCT No.: PCT/EP2009/051529

§ 371 (c)(1), (2), (4) Date: Dec. 17, 2010

(87) PCT Pub. No.: WO2009/121653

PCT Pub. Date: Oct. 8, 2009

(65) Prior Publication Data

US 2011/0103943 A1 May 5, 2011

(30) Foreign Application Priority Data

Apr. 3, 2008 (EP) ..... 08006814

(51) Int. Cl.
*F04D 29/60* (2006.01)

(52) U.S. Cl.
USPC ..... 415/209.2

(58) Field of Classification Search
USPC ..... 415/126; 416/204, 205, 207, 219
See application file for complete search history.

(56) References Cited

U.S. PATENT DOCUMENTS

| | | | | |
|---|---|---|---|---|
| 2,488,867 | A | 11/1949 | Judson | |
| 2,628,067 | A | 2/1953 | Lombard | |
| 2,918,253 | A | 12/1959 | Mackay | |
| 5,605,071 | A * | 2/1997 | Buchanan, Jr. | 74/425 |
| 5,992,259 | A * | 11/1999 | Fleytman | 74/425 |
| 6,155,136 | A * | 12/2000 | Telly et al. | 74/606 R |
| 6,739,992 | B2 * | 5/2004 | Kummerle | 473/582 |

FOREIGN PATENT DOCUMENTS

| | | | |
|---|---|---|---|
| DE | 10 2005 021 446 | B3 | 6/2006 |
| JP | 60081402 | A | 5/1985 |
| WO | WO 2006/103152 | A1 | 10/2006 |
| WO | WO 2008/012195 | A1 | 1/2008 |

OTHER PUBLICATIONS

Eitel, Elisabeth, Even the Worm will turn, Jan. 2004, Motion System Design 46.1, 34-36.*

* cited by examiner

*Primary Examiner* — Nathaniel Wiehe
*Assistant Examiner* — Eldon Brockman

(57) ABSTRACT

A guide disc segment for a horizontally split turbomachine housing is provided. The guide disc segment includes a plurality of guide blades and an outer ring segment. The guide blades are fixed to the outer ring segment along an inner circumference. The outer ring segment can be rolled into or out of a guide blade carrier of the turbomachine housing. The outer ring segment has, along an outer circumference, a toothing into which a drive device engages. A tangential force can be applied to the outer ring segment by the toothing such that the guide disc segment can be driven during the rolling into or rolling out of the outer ring segment.

4 Claims, 4 Drawing Sheets

FIG 2 Detail A
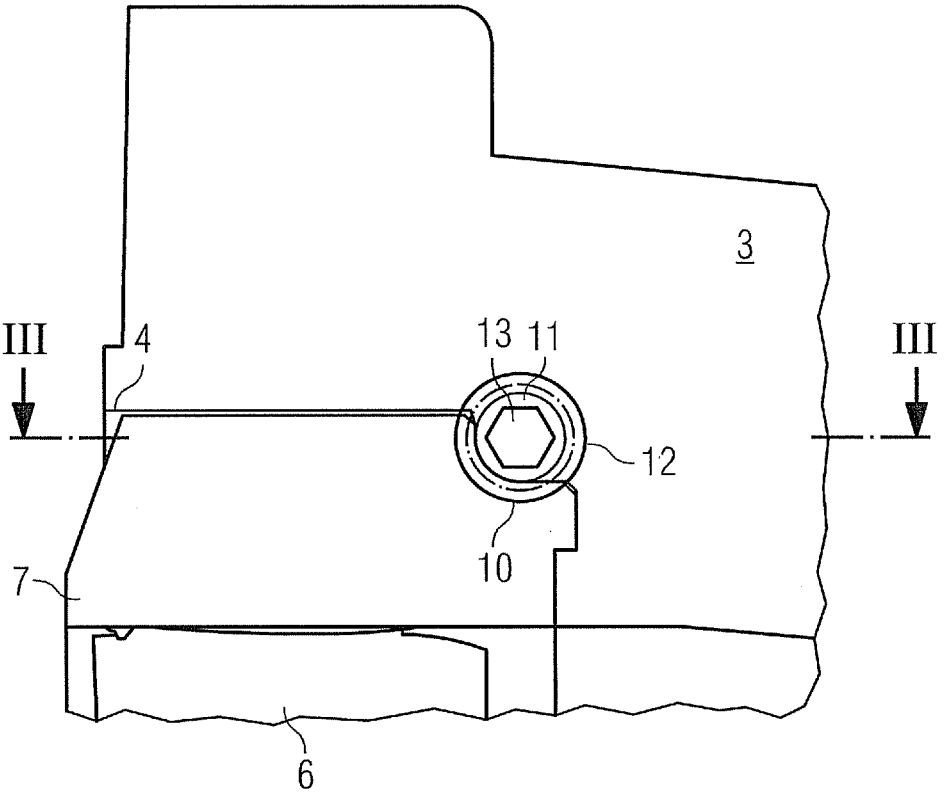
FIG 3
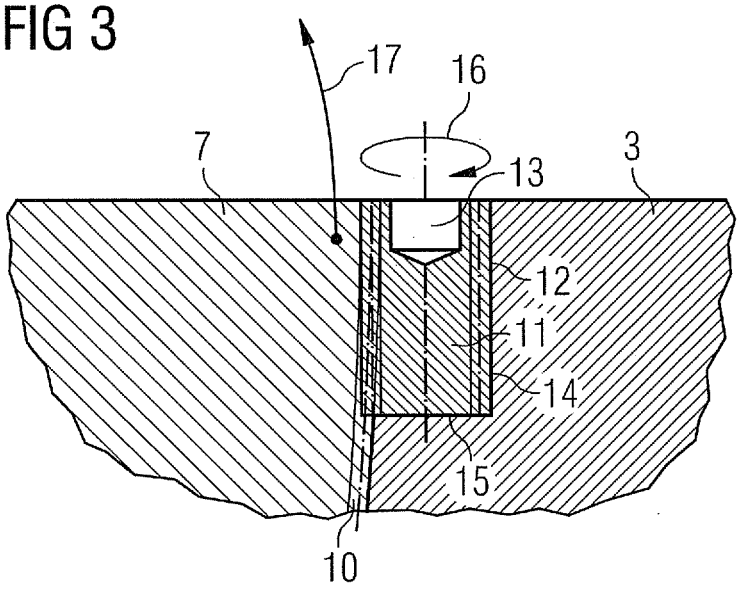

DEVICE FOR A HORIZONTALLY SPLIT TURBOMACHINE HOUSING, GUIDE VANE RING SEGMENT AND GUIDE VANE CARRIER FOR A HORIZONTALLY SPLIT TURBOMACHINE HOUSING

CROSS REFERENCE TO RELATED APPLICATIONS

This application is the US National Stage of International Application No. PCT/EP2009/051529 filed Feb. 11, 2009, and claims the benefit thereof. The International Application claims the benefits of European Patent Application No. 08006814.1 EP filed Apr. 3, 2008. All of the applications are incorporated by reference herein in their entirety.

FIELD OF INVENTION

The invention refers to a device for a horizontally split turbomachine casing, a guide vane ring segment and a guide vane carrier for a horizontally split turbomachine casing, and to a method for rolling the guide vane ring segment into the guide vane carrier or for rolling the guide vane ring segment out of it.

BACKGROUND OF INVENTION

A turbomachine is for example a gas turbine with a compressor in an axial type of construction. The compressor customarily has a horizontally split casing, as a result of which internal components of the compressor can be installed in the casing halves which have been lifted away from each other. Counted among these is a guide vane ring of the compressor, which is formed by two guide vane ring segments.

In FIGS. 4 and 5, the installation of a guide vane ring segment 102 in a compressor casing 101 is shown. The guide vane ring segment 102 forms a 180°-half of the entire guide vane ring, so that two guide vane ring segments 102, in an arrangement in which they are fitted together, form a guide vane ring. The guide vane ring segment 102 is installed in the bottom section of the compressor casing 101, wherein the installation is carried out by means of an installation device 103, as is shown in FIG. 4. The installation device 103 is modeled on the guide vane ring segment 102 and has plates 104 upon which the guide vane ring segment 102 is fastened. As is shown in FIG. 5, phase 0, the guide vane ring segment 102 is embedded in the bottom section of the compressor casing 101, to the effect that the installation device 103 projects upwards.

For rolling out the guide vane ring segment 102 from the bottom half of the compressor casing 101, on a crane application point 105, which is arranged on the outer circumference of the installation device 103, a vertically upwards-directed force F is exerted by a crane so that the installation device 103 with the guide vane ring segment 102 fastened thereupon is rotated by a pivoting angle 106 (see phase 2 in FIG. 5). By repositioning the crane application point 105 in phases 2 to 4 in FIG. 5, by operating the crane and applying the force F on the crane application point 105 step-by-step, the installation device 103 with the guide vane ring segment 102 fastened thereupon is rotated a bit at a time until in phase 4 in FIG. 5 the installation device 103 is completely encompassed by the bottom section of the compressor casing 101 and the guide vane ring segment 102 projects upwards from the compressor casing 101. After releasing the plates 104 from the guide vane ring segment 102, the guide vane ring segment 102 can be removed from the compressor casing 101. The rolling in and rolling out of the guide vane ring segment 102 by operating the crane is inconvenient, time-consuming and requires a high level of skill.

Furthermore, a method for rolling out and rolling in a guide vane carrier from a casing of a gas turbine or into its casing is known from WO 2008/012195 A1 and from WO 2006/103152 A1. A bottom half of the guide vane carrier which lies in the casing is supported on the inner side of the casing via a plurality of rolling bearings. After installing a half-ring on the lower half of the guide vane carrier, this can be rolled out from the bottom half of the casing by means of a 180°-pivoting movement, which is actuated by a cable pull. With this, it is disadvantageous that the force which is initiated via the cable pull does not always act tangentially on the guide vane carrier, which can lead to damage.

Furthermore, a guide vane ring, moving at a lower speed, for the first turbine stage of a gas turbine, is known from printed patent specification DE 10 2005 021 446 B3.

By means of the rotating guide vane ring, different thermal loads of guide vanes are to be avoided. So as not to exceed a comparatively low speed in this case, the guide vane ring is braked via a worm gear by a brake.

Furthermore, guide vanes are known for example from U.S. Pat. No. 2,628,067 and from U.S. Pat. No. 2,488,867, the outer fastening means of which are in toothed immovable engagement with a carrier element for diverting the flow forces which act upon the first-mentioned.

SUMMARY OF INVENTION

It is an object of the invention to create a device for a horizontally split turbomachine casing, a guide vane ring segment and a guide vane carrier for a horizontally split turbomachine casing, and a method for rolling the guide vane ring segment into the guide vane carrier and/or for rolling the guide vane ring segment out of it, wherein the guide vane ring segment can be installed and/or removed quickly and reliably by means of rolling it into or rolling it out of the guide vane carrier.

The device comprises a guide vane carrier, a drive device and a guide vane ring segment with a plurality of guide vanes and an outer ring segment on which the guide vanes are arranged along its circumference and which can be rolled into the guide vane carrier and/or rolled out of this, wherein the outer ring segment has toothing along its outer circumference, in which the drive device engages and by which a tangential force can be applied to the outer ring segment for installing and removing the guide vane ring segment in or from the guide vane carrier, so that the guide vane ring segment can be driven during the rolling in and/or rolling out processes.

The guide vane ring segment for a horizontally split turbomachine casing has a plurality of guide vanes and an outer ring segment on which the guide vanes are arranged along its inner circumference, wherein the outer ring segment has a toothing along its outer circumference.

The guide vane carrier for a horizontally split turbomachine casing, into which or out of which a guide vane ring segment can be rolled, has a worm element with helical toothing for engaging in toothing which is provided along the outer circumference of the guide vane ring segment.

The method for installing and removing a guide vane ring segment by means of rolling the guide vane ring segment into and/or out of the guide vane carrier, features the following steps: providing the guide vane ring segment and the guide vane carrier; rotating the worm element so that the guide vane ring segment is circumferentially driven by the worm element, wherein the guide vane ring segment is rolled into the guide vane carrier or rolled out of the guide vane carrier.

On its outer ring segment, the guide vane ring segment has the toothing in which the worm element engages by its helical toothing. The helical toothing of the worm element is helically formed around the longitudinal axis of the worm element so that if the worm element is rotated around its longitudinal axis the guide vane ring segment is circumferentially driven on the outer ring segment. Consequently, as a result of rotating the worm element the guide vane ring segment can be rotated in the guide vane carrier, as a result of which by the rotational operation of the worm element the rolling of the guide vane ring segment into and/or out of the guide vane carrier can be carried out. Therefore, the rolling in and/or rolling out processes can be handled in a simple and reliable manner, wherein an additional crane does not need to be used. It is particularly advantageous in this case that the force which acts upon the guide vane ring segment, and which is necessary for its movement, always acts tangentially on the guide vane ring segment. Therefore, forces which act obliquely on the compressor casing or guide vane ring segment, which could possibly lead to damage or wear, are avoided.

The toothing of the outer ring segment is preferably globoid toothing and the helical toothing of the worm element is preferably globoid toothing.

As a result, the contact region of the toothing of the outer ring and the helical toothing of the worm element is in a flat form, as a result of which wear, especially on the helical toothing of the worm element, is low.

The globoid toothing has a concave structure in each of the planes in which lies the longitudinal axis of the turbomachine casing.

Consequently, the worm element is at least partially encompassed by the globoid toothing of the outer ring segment, as a result of which the contact surface of the outer ring segment by the worm element is large. Therefore, the worm element by its helical toothing, which engages in the toothing of the outer ring segment, is guided in a rotatable manner, as a result of which skewing of the worm element in the toothing of the outer ring segment is prevented.

In addition, it is preferred that the concave contour of the globoid toothing of the outer ring segment describes a quadrant.

As a result, the globoid toothing of the outer ring segment can advantageously be provided for example in the region of an imaginary outer edge of the outer ring segment, as a result of which the guide vane ring segment can be produced in a simple manner and the worm element is easily accessible from the outside.

It is preferred that the guide vane carrier has a side open blind hole with a bottom on which the worm element is supported.

In this way, the effect of the worm element being retained in the guide vane carrier in a stable manner is advantageously achieved, as a result of which the worm element can be reliably operated. The worm element in this case projects at the side from the blind hole and can therefore be brought into engagement with the toothing of the guide vane ring segment.

Furthermore, it is preferred that the worm element has a polygonal socket profile on which the worm element can be driven by means of a tool which can interact with the polygonal socket profile.

The tool can be formed for example as a crank with a male hexagonal profile which can be inserted into the polygonal socket profile of the worm element. If the crank is rotated by hand, the worm element is rotated and the guide vane ring segment is simply and conveniently rolled out of the guide vane carrier or rolled into the guide vane carrier.

According to a further advantageous solution, the bottom of the blind hole has a further blind hole in the center, in which a spigot, which is arranged on the worm element, projects for centering the worm element.

As a result of centering the worm element, this is always reliably positioned at its end which is opposite the drive so that a comparatively small amount of wear ensues on the worm gear which is formed from toothing of the guide vane ring segment and worm element.

In addition, it is preferred that the worm element is installed on the guide vane carrier only for rolling in and/or rolling out the guide vane ring segment.

That is to say, as soon as rolling in and/or rolling out of the guide vane ring segment is finished, the worm element can be removed from the guide vane carrier. By the same token, the worm element can also be installed in the guide vane carrier during operation of the turbomachine.

BRIEF DESCRIPTION OF THE DRAWINGS

In the following text, the invention is explained based on a preferred exemplary embodiment of a guide vane ring segment and of a guide vane carrier, with reference to the attached schematic drawings. In the drawing:

FIG. 2 shows a detail A from FIG. 1, FIG. 3 shows a section B-B from FIG. 2.

DETAILED DESCRIPTION OF INVENTION

Figure 1:
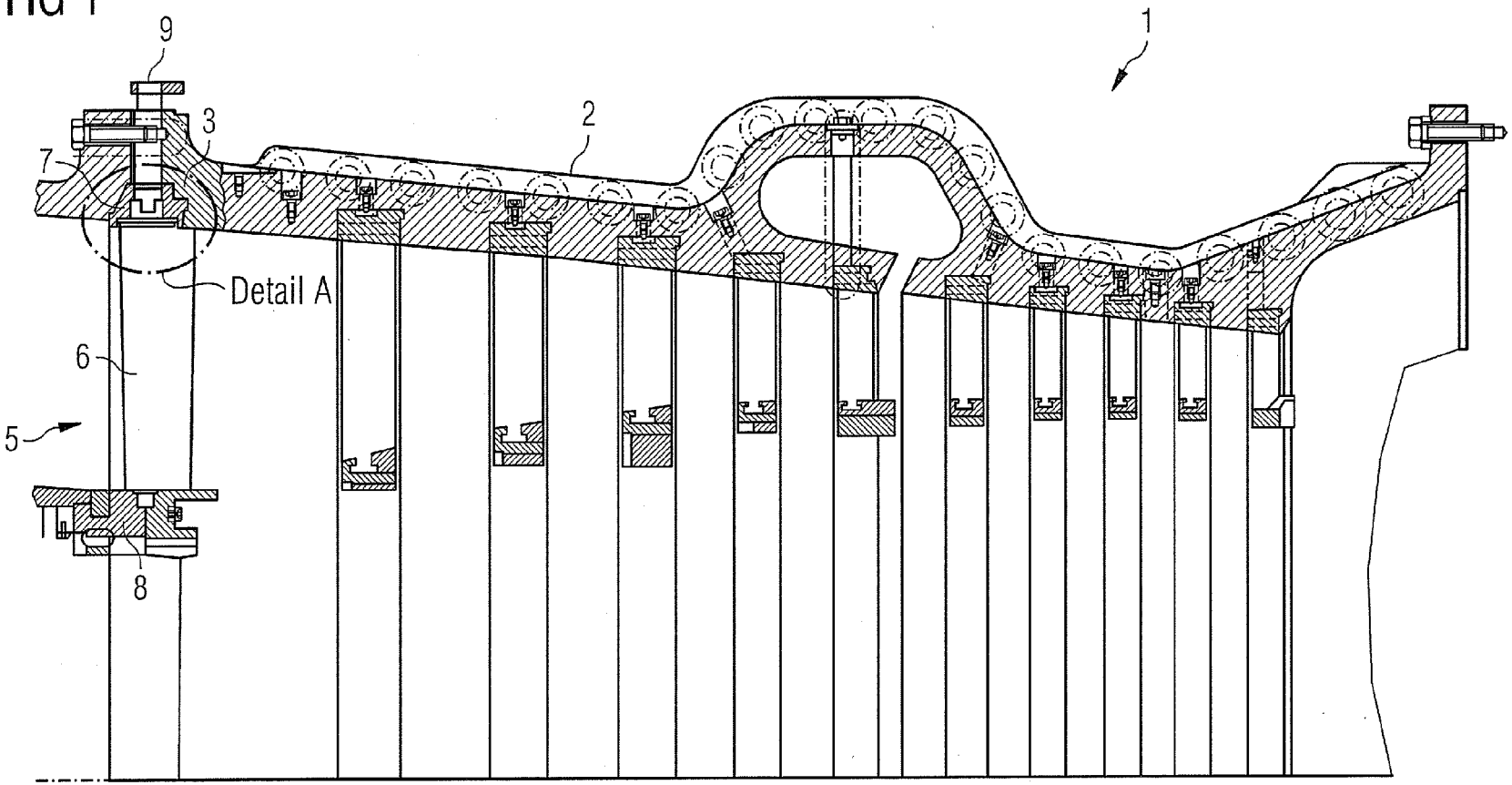
FIG. 1 shows a longitudinal section through a horizontally split axial compressor casing.
Figure 4:
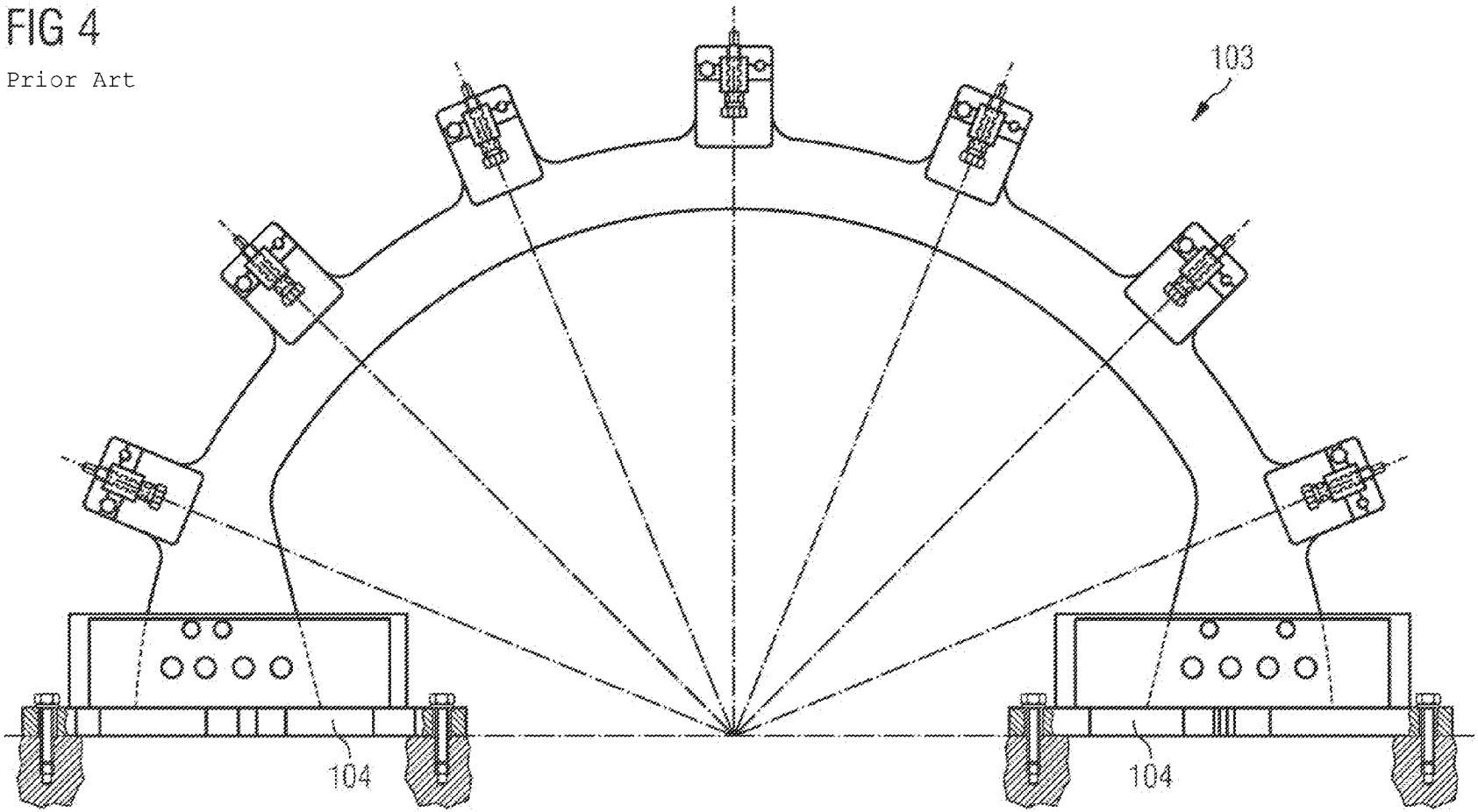
FIG 4 Prior Art
FIG. 4 shows a conventional installation device and FIG. 5 shows installation phases during conventional rolling out of the guide vane ring segment from a compressor casing.
Figure 5:
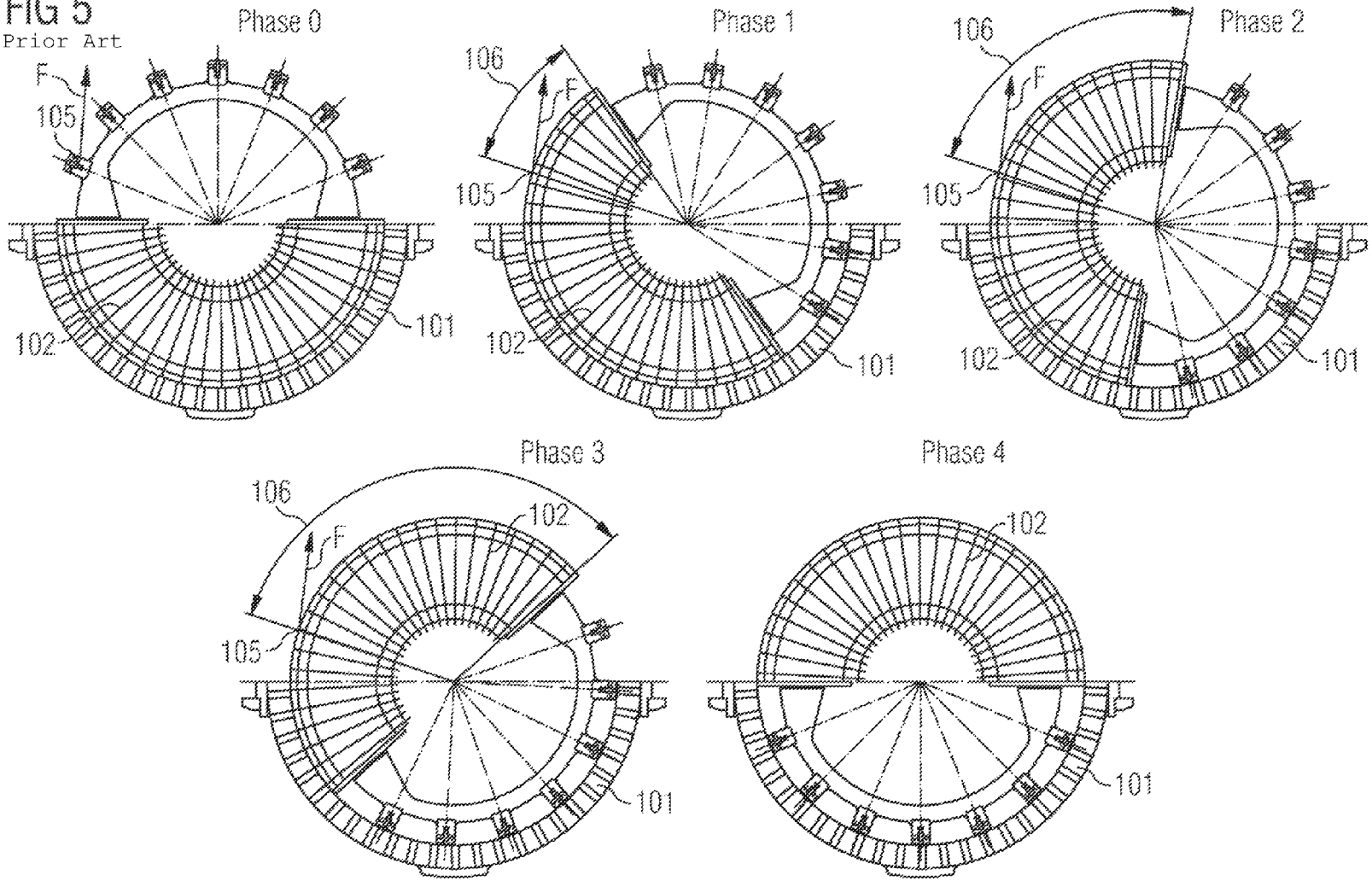
FIG 5 Prior Art

As is apparent from FIGS. 1 to 3, an axial compressor 1 has a compressor casing 2 which is split horizontally. Provision is made for a guide vane carrier 3 which is integrated in the compressor casing 2 and on its inner circumference has a circumferential slot 4 for accommodating a guide vane ring segment 5. For the sake of clarity, in FIG. 1 the compressor rotor, with the compressor rotor blades arranged thereupon, is not shown.

The guide vane ring segment 5 extends over a circumferential angle of 180°. Each guide vane ring segment 5 has a large number of guide vanes 6 which are arranged next to each other in the circumferential direction so that two guide vane ring segments 5 assembled together form a complete guide vane ring for the compressor 1. The guide vanes 6 of the guide vane ring then form in their entirety a guide vane cascade of the compressor.

The guide vane ring segment 5 on its outer edge has an outer ring segment 7 and on its inner circumference has an inner ring segment 8, wherein the guide vanes 6 are arranged in a radially disposed manner between the outer ring segment 7 and the inner ring segment 8. The guide vanes 6 are formed in a longitudinally extended manner, wherein an outer longitudinal end is pivotably arranged on the outer ring segment 7 and an inner longitudinal end is pivotably arranged on the inner ring segment 8. In the installed state, the guide vanes 6 can be pivoted around their longitudinal axis by means of an adjusting mechanism 9, wherein the adjusting mechanism 9 is accessible from outside the compressor casing 2. The guide vanes 6 of the guide vane ring preferably form the pivotable inlet guide vanes of the compressor.

The guide vane ring segment 5 engages by its outer ring segment 7 in the circumferential slot 4, wherein the guide vane carrier 3 can be part of the compressor casing 2. For removal, the guide vane ring segment 5 is to be rotated by 180°, that is to say out of the guide vane carrier 3, until the outer ring segment 7 disengages from the circumferential slot 4.

The outer ring segment 7, on an outer circumferential edge, has a globoid toothing 10 which, in each plane in which the longitudinal axis of the guide vane carrier 3 lies, is formed in the manner of a quadrant. In addition, the guide vane carrier 3 has a worm element 11 which has a cylindrical shape. On the outer circumference of the worm element 11, provision is made for helical toothing 12 which is formed in such a way that it can interact with the globoid toothing 10, forming a worm drive.

The worm element 11 is arranged in a blind hole 14, which is provided in the guide vane carrier 3, so that the worm element 11 is retained in the blind hole 14 while the worm element engages by its helical toothing 12, via a quadrantal circumference, in the globoid toothing 10.

The blind hole 14 has a bottom 15 on which the worm element 11 is supported in its longitudinal direction. In the bottom 15, moreover, provision is made for a further blind hole 18 into which a spigot 19, which is centrally arranged on the worm element 11, rotatably projects for centering the worm element 11. In addition, the worm element 11 has a hexagonal socket profile 13 on its face end which faces away from the bottom 15. A crank, for example, with a correspondingly formed male hexagonal profile, can engage in the hexagonal socket profile 13.

If the worm element 11 is rotated, for example by the crank, in the rotational direction 16, a circumferential force is exerted in the pivoting direction 17 by the helical toothing 12 upon the globoid toothing 10 and the outer ring segment 7. As a result of the force which constantly acts in the circumferential direction by the drive, the guide vane ring segment 5 can be slid out of the guide vane carrier without skewing. On account of the coupling of outer ring segment 7 and inner ring segment 8 by means of the guide vanes 6 and, if necessary, by means of an installation device 103 which is connected to the guide vane ring segment 5, by rotating the worm element 11 the guide vane ring segment 5 can be completely slid out of the guide vane carrier 3 half.

The worm element 11 with the outer ring segment 7, via the helical toothing 12 and the globoid toothing 10, forms the worm drive. On account of friction forces, which occur particularly during movement of the outer ring segment 7 in the circumferential slot 4, the worm element 11 is pressed into the blind hole 14. In this case, the worm element 11 is supported on the bottom 15 in a stable manner.

By operating the worm drive, the guide vane ring segment 5, therefore, is rotated around the longitudinal axis of the compressor. The guide vane ring segment 5, which is located in the guide vane carrier 3, is slid out of the guide vane carrier 3, more precisely out of its circumferential slot 4. This process is referred to as rolling out within the meaning of the patent application. In the case of rolling in, that is to say with the process in reverse, the guide vane ring segment 5 is slid into the guide vane carrier 3 or into its circumferential slot 4. In other words, the rotating out movement or rotating in movement of the guide vane ring segment 5 around the longitudinal axis of the compressor, or the sliding of the guide vane ring segment 5 out of or into the circumferential slot 4 of the guide vane carrier 3 or of the compressor casing 2 is to be understood by rolling out and by rolling in.

If the installation or removal process of the guide vane ring segment 5 is completed, the worm element 11 can be removed from the blind hole 14 so that during further handling of the axial compressor or during its operation the worm element 11 is not accommodated in the blind hole 14 of the guide vane carrier 3. On the other hand, if the worm element 11 is not to be provided separately for installing or removing the guide vane ring segment 5, the worm element 11 can remain in the blind hole 14 even during operation of the axial compressor 1.

Naturally, the guide vane ring segment and the drive associated with it can be used not only with inlet guide vanes of a compressor but also with guide vane rings which are arranged downstream of them, the guide vanes of which can also be pivoted around their longitudinal axes if necessary. In addition to this, rolling in and/or rolling out of the guide vane ring 5 can also be carried out in the case of the rotor which is installed in the lower casing half.

The invention claimed is:

1. A guide vane carrier for a horizontally split turbomachine casing, comprising:

a slot extending in a circumferential direction for accommodating a guide vane ring segment which can be rolled into or rolled out of the slot;

a worm element with a helical toothing for engaging in a toothing provided along an outer circumference of the guide vane ring segment; and a blind hole with a bottom, the worm element being supported on the blind hole, wherein the worm element has a polygonal socket profile, the worm element being driven by a tool interacting with the polygonal socket profile.

2. The guide vane carrier as claimed in claim 1, wherein the helical toothing is a globoid toothing.

3. A device for a horizontally split turbomachine casing, comprising:

a guide vane carrier;

a drive device; a guide vane ring segment with a plurality of guide vanes and an outer ring segment, wherein the guide vanes are arranged on the outer ring segment along an inner circumference of the outer ring segment, wherein the outer ring segment is moveable into the guide vane carrier or moveable out of the guide vane carrier, wherein the outer ring segment has a toothing along an outer circumference of the outer ring segment, wherein the drive device engages into the toothing, wherein a tangential force can be applied to the outer ring segment for installing and removing the guide vane ring segment in or from the guide vane carrier such that the guide vane ring segment is drivable during a moving into or a moving out of the outer ring segment, and wherein the drive device comprises a rotatable worm element so that the guide vane ring segment is circumferentially drivable by the worm element, wherein the toothing is a globoid toothing, wherein the globoid toothing includes a plurality of teeth with concave contours, wherein a longitudinal axis of each tooth and a longitudinal axis of the turbomachine casing lie in a same plane, wherein the guide vane carrier comprises a blind hole with a bottom, wherein the worm element is supported by the blind hole, and wherein the worm element includes a polygonal socket profile, the worm element being driven by a tool interacting with the polygonal socket profile.

4. The device as claimed in claim 3, wherein each concave contour of the globoid toothing of the outer ring segment envelopes at least approximately 90 degrees of a circumference of the worm element in a plane that lies perpendicular to a longitudinal axis of the worm element.

* * * * *

UNITED STATES PATENT AND TRADEMARK OFFICE

CERTIFICATE OF CORRECTION

PATENT NO. : 8,708,648 B2
APPLICATION NO. : 12/935995
DATED : April 29, 2014
INVENTOR(S) : Alexandra Küpper and Walter Loch It is certified that error appears in the above-identified patent and that said Letters Patent is hereby corrected as shown below:

On the title page item (75), Inventor ALEXANDER KÜPPER should be ALEXANDRA KÜPPER.

Signed and Sealed this
Twenty-first Day of October, 2014

Michelle K. Lee

Michelle K. Lee
*Deputy Director of the United States Patent and Trademark Office*